US010566707B2

(12) United States Patent
Lappoehn

(10) Patent No.: US 10,566,707 B2
(45) Date of Patent: Feb. 18, 2020

(54) ELECTRICAL CRIMP CONTACT

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 16/096,018

(22) PCT Filed: Feb. 21, 2017

(86) PCT No.: PCT/DE2017/100145
§ 371 (c)(1),
(2) Date: Oct. 24, 2018

(87) PCT Pub. No.: WO2017/186208
PCT Pub. Date: Nov. 2, 2017

(65) Prior Publication Data

US 2019/0140367 A1 May 9, 2019

(30) Foreign Application Priority Data

Apr. 25, 2016 (DE) ..... 10 2016 107 659

(51) Int. Cl.
*H01R 4/00* (2006.01)
*H01R 4/18* (2006.01)

(52) U.S. Cl.
CPC ..... *H01R 4/188* (2013.01); *H01R 4/185* (2013.01)

(58) Field of Classification Search
CPC . H01R 4/02; H01R 4/04; H01R 4/188; H01R 4/185; H01R 4/18; H01R 43/14
(Continued)

(56) References Cited

U.S. PATENT DOCUMENTS 3,112,150 A * 11/1963 Hammell ..... H01R 4/185 174/84 C
3,533,055 A * 10/1970 Zak ..... H01R 4/188 174/84 C (Continued)

FOREIGN PATENT DOCUMENTS

CN 101317301 12/2008
CN 101420142 A 4/2009

(Continued)

OTHER PUBLICATIONS

English translation of the International Preliminary Report on Patentability and Written Opinion of International Searching Authority in PCT/DE2017/100145, dated Nov. 8, 2018.

(Continued)

*Primary Examiner* — William H. Mayo, III
(74) *Attorney, Agent, or Firm* — Collard & Roe, P.C.

(57) ABSTRACT

A contact sleeve for connecting at least one stranded wire has a receiving region extending longitudinally to a central line. The central line runs parallel to the stranded wire for inserting stripped ends of the at least one stranded wire and has two crimp wings that are each directed towards each other. In the folded state, the two crimp wings clamp the stripped ends. The crimp wings have grooves that run on both crimp wings relative to the central line in the shape of an arrow. The grooves run outwards, in each case starting from the central line and being curved with a continuously decreasing gradient.

5 Claims, 2 Drawing Sheets

(58) Field of Classification Search
USPC ..... 174/84 R, 84 C
See application file for complete search history.

(56) References Cited

U.S. PATENT DOCUMENTS

| | | | | |
|---|---|---|---|---|
| 4,074,065 | A * | 2/1978 | Leaf | H01R 4/20 174/84 C |
| 6,232,555 | B1 * | 5/2001 | Besler | H01R 4/182 174/84 C |
| 6,867,372 | B2 * | 3/2005 | Fujiwara | H01B 7/295 174/128.1 |
| 7,544,892 | B2 * | 6/2009 | Susai | H01R 4/188 174/84 C |
| 9,768,524 | B2 | 9/2017 | Seipel et al. | |
| 2005/0221691 | A1 | 10/2005 | Li | |
| 2008/0230269 | A1 * | 9/2008 | Susai | H01R 4/188 174/84 C |
| 2009/0133927 | A1 * | 5/2009 | Onuma | H01R 4/20 174/84 C |
| 2010/0055998 | A1 | 3/2010 | Aihara | |
| 2010/0230160 | A1 * | 9/2010 | Ono | H01R 4/185 174/84 C |
| 2011/0028054 | A1 * | 2/2011 | Tanaka | H01R 4/185 439/878 |
| 2011/0094797 | A1 * | 4/2011 | Otsuka | H01R 43/0207 174/84 C |

FOREIGN PATENT DOCUMENTS

| | | | |
|---|---|---|---|
| CN | 202259705 | U | 5/2012 |
| DE | 36 34 099 | C2 | 4/1988 |
| DE | 20 2013 010 987 | U1 | 3/2014 |
| DE | 10 2013 203 796 | A1 | 9/2014 |
| JP | 2003-249284 | A | 9/2003 |
| JP | 2009-245697 | A | 10/2009 |
| JP | 2010055937 | | 3/2010 |
| JP | 2014-164865 | A | 9/2014 |
| JP | 2015-130311 | A | 7/2015 |
| WO | 2009/096590 | A1 | 8/2009 |
| WO | 2009/119514 | A1 | 10/2009 |

OTHER PUBLICATIONS

International Search Report of PCT/DE2017/100145, dated May 18, 2017.

Canadian Office Action dated Oct. 18, 2019 in Canadian Application No. 3,022,012.

European Office Action dated Nov. 13, 2019 in European Application No. 17 711 083.0 with English translation of the relevant parts.

Chinese Office Action in CN 201780032896.3, dated Sep. 29, 2019.

* cited by examiner

ELECTRICAL CRIMP CONTACT

CROSS REFERENCE TO RELATED APPLICATIONS

This application is the National Stage of PCT/DE2017/100145 filed on Feb. 21, 2017, which claims priority under 35 U.S.C. § 119 of German Application No. 10 2016 107 659.7 filed on Apr. 25, 2016, the disclosure of which is incorporated by reference. The international application under PCT article 21(2) was not published in English.

The invention relates to a contact sleeve for connecting at least one stranded wire.

PRIOR ART

Such crimp contacts arise from DE 10 2013 203 796 A1, for example. Furthermore, crimp contacts are known from WO 2009/119514 A1.

Electric connection and terminal clamps also arise from DE 36 34 099 C2, JP 2003 249 284 A or WO 2009/096590 A1, for example.

An electric crimp contact device having grooves running in an arrow shape arises from DE 10 2013 203 796 A1 in particular, said grooves serving as a fixing device for the cable ends to be contacted.

DISCLOSURE OF THE INVENTION

The contact sleeve according to the invention for connecting at least one stranded wire having grooves running on two crimp wings in an arrow shape relative to the central line, said grooves running outwards, in each case starting from the central line and being curved with a continuously decreasing gradient, has the advantage of a fixed and gas-tight contacting of stranded wires. The strands are pressed together substantially better still by the curved grooves running in a wing-like manner than with grooves that are not curved. This has been shown by extensive research by the applicant.

Preferably, the grooves start on the central line and extend across the crimp wings up to a predetermined distance from the end of the crimp wings or even up to the end of the crimp wings itself.

To a certain extent, the grooves run in a wing-shaped manner in the same way as bird wings. The gradient of a tangent to the grooves on the central line has an angle of 83±2° relative to the central line, according to an advantageous embodiment, and this gradient of the tangent decreases towards the edge of the grooves until it forms an end angle of about 88±1° with the central line. In the region of the central line where the crimp wings only travel a short way during crimping, there is thus a greater gradient of the grooves than on the external edge of the crimp wings that travel a longer way during the crimping process.

Purely in principle, the grooves could be formed to be asymmetrical relative to the central line, i.e. the grooves on the one side can run differently to the grooves on the other side. A particularly preferred embodiment provides that the grooves run symmetrically relative to the central line.

The formation of the grooves can take place in many different ways. An advantageous embodiment provides that the groves are groove-like recesses that are arranged on the sides of the receiving region and the crimping wings facing towards the stranded wire.

SHORT DESCRIPTION OF THE DRAWINGS

Exemplary embodiments of the invention are depicted in the figures and are explained in more detail in the description below.

EMBODIMENTS OF THE INVENTION

Figure 1:
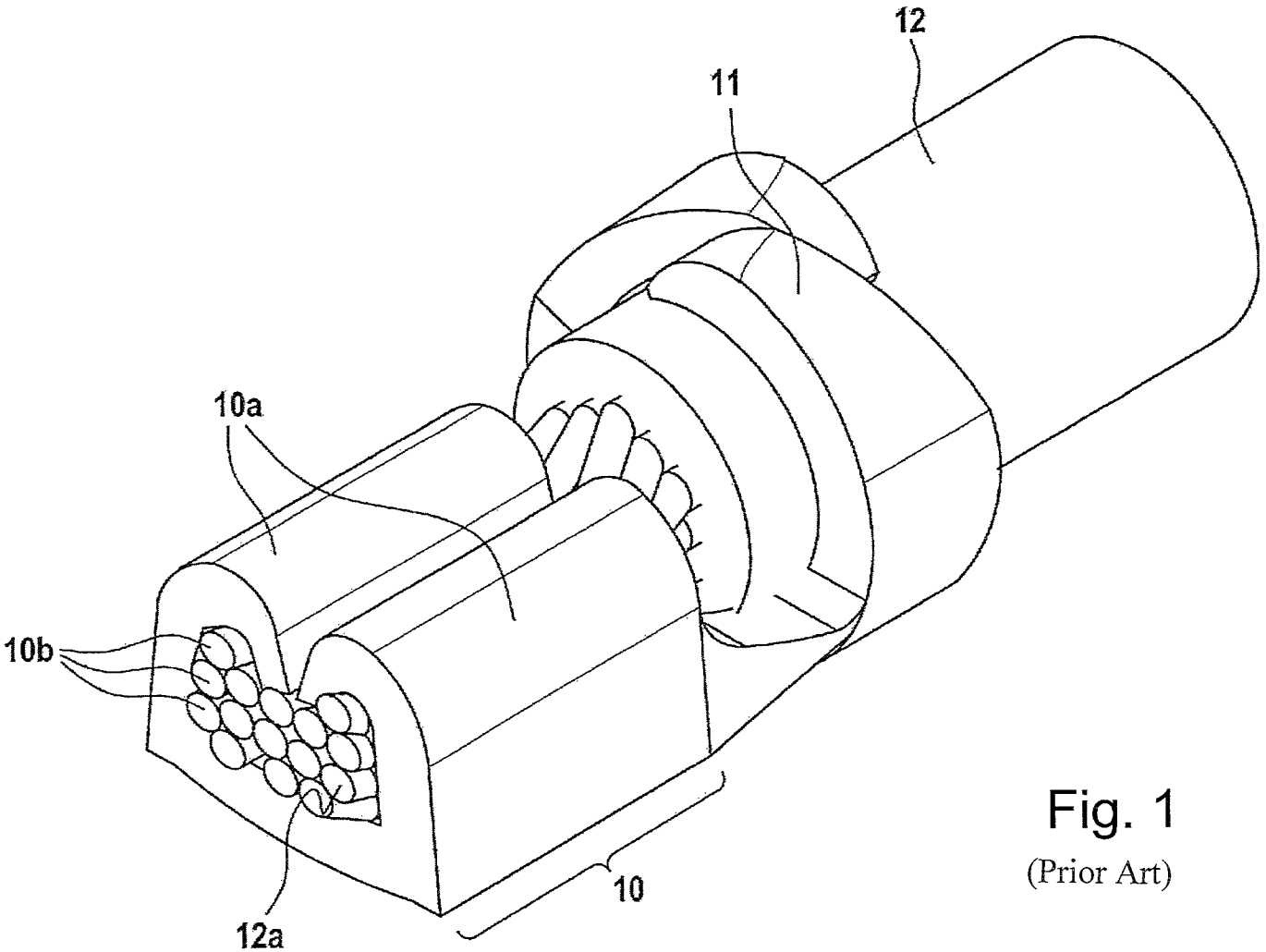
Fig. 1 (Prior Art)
FIG. 1 shows a contact sleeve having crimp wings according to prior art.

A contact sleeve depicted in FIG. 1 has a contact crimping region 10 that serves to press strands 10*b* together with the crimping wings 10*a*, and an insulating crimping region 11 for fixing the contact crimping region 10 on an insulator of a stranded wire 12. The contact crimping region 10 has a receiving surface 12*a*. It serves, together with the crimping wings 10*a*, to press the strands 10*b* together, in an inherently known manner. The insulating crimping region 11 that surrounds an insulator of the stranded wire 12 is arranged attaching the contact crimping region 10. The insulating crimping region 11 surrounds and clamps the stranded wire 12 and thus serves to fix the stranded wire 12 and the strain relief thereof.

Figure 2:
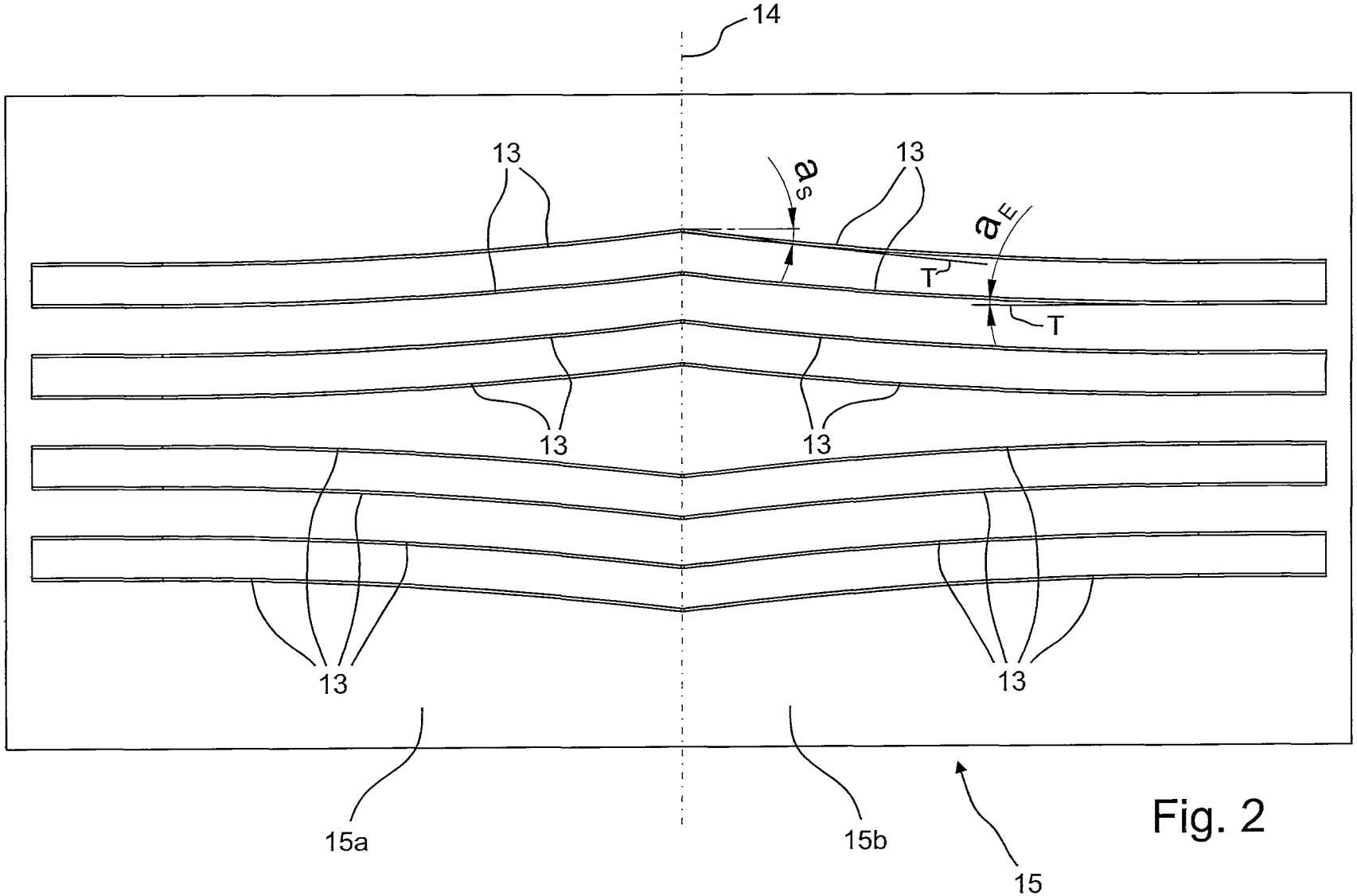
FIG. 2 shows a plan view of a contact crimping region according to the invention.

A plan view depicted in FIG. 2 on a contact crimping region 15 that has two crimp wings 15*a*, 15*b* comprises grooves 13 arranged to be symmetrical relative to a central line 14, said grooves 13 running curved in a wing-shaped manner in the same way as bird wings. The curvature is thus formed in such a way that a tangent to the grooves forms an angle as with the central line 14 in the region of the central line 14. The gradient decreases constantly to the external edge of the crimp wing 15*a*, 15*b*, such that the gradient of the grooves forms an angle $\alpha_E$ relative to the central line 14 in the external region.

Research by the applicant has shown that the angle as is preferably about 83±2°, whereas the angle $\alpha_E$ is about 88±1°.

Because of this shape of the grooves that runs curved and has a curvature that continuously decreases from the central line 14 outwards in the direction of the edge of the crimp wings 15*a*, 15*b*, an optimal pressing of the strands together in the crimp wings 15*a*, 15*b* is achieved. Thus, the arrangement of the grooves that runs curved takes into account the fact that, during crimping, the crimp wings 15*a*, 15*b* only travel a short way in the region of the central line 14, whereas they travel a great way in the external region of the crimp wings 15*a*, 15*b*. This smaller way in the region of the central line 14 is taken into account by the greater gradient of the grooves, whereas the greater way travelled during crimping in the external region of the crimp wings 15*a*, 15*b* is taken into account by the smaller gradient. The crimping by means of these curved grooves enables an optimal contacting of the strands, in particular a gas-tight contacting of stranded wires, which cannot be achieved by grooves running linearly.

The grooves running curved are preferably formed symmetrically relative to the central line 14. It can, however, also be provided in an alternative embodiment to form the grooves unsymmetrically, i.e. to provide grooves on one crimp wing that have a different gradient to those on the other crimp wing. The grooves are indentations, corrugations or similar, for example, that project in the direction of the strands and thus press the strands together.

The grooves preferably start on the central line 14 and extend across the crimp wings 15*a*, 15*b* up to a predetermined distance from the end of the crimp wings or even up to the end of the crimp wings itself.

The invention claimed is:

1. A contact sleeve for connecting at least one stranded wire having a receiving region extending longitudinally to a central line (14) running in parallel to the stranded wire for inserting stripped ends of the at least one stranded wire and having two crimp wings (15*a*, 15*b*) that are each directed towards each other and, in the folded state, clamp the stripped ends, wherein the crimp wings (15*a*, 15*b*) have grooves (13) that run on both crimp wings relative to the central line in the shape of an arrow, wherein the grooves (13) run outwards in a direction of an edge of the crimp wings, in each case starting from the central line and being curved with a continuously decreasing gradient.

2. The contact sleeve according to claim 1, wherein the grooves (13) start on the central line (14) and extend across the crimp wings (15*a*, 15*b*) up to a predetermined distance from the end of the crimp wings (15*a*, 15*a*).

3. The contact sleeve according to claim 2, wherein the gradient of a tangent to the grooves (13) on the central line (14) has an angle ($\alpha_S$) of about 83±2° with a line vertical relative to the central line and decreases up to an angle ($\alpha_E$) of 88±1° with a line perpendicular to the central line on the end of the grooves (13).

4. The contact sleeve according to claim 1, wherein the grooves (13) run symmetrically relative to the central line (14).

5. The contact sleeve according to claim 1, wherein the grooves (13) are groove-like indentations that are arranged on the side of the receiving region and the crimp wings (15*a*, 15*b*) facing towards the stranded wire.

* * * * *